US010746511B2

(12) United States Patent
Howard

(10) Patent No.: US 10,746,511 B2
(45) Date of Patent: Aug. 18, 2020

(54) APPARATUS FOR GENERATING A VITALS TARGET

(71) Applicant: JMA Outdoors, Inc., Lafayette, CO (US)

(72) Inventor: David Gene Howard, Lafayette, CO (US)

(73) Assignee: JMA Outdoors, Inc., Lafayette, CO (US)

( * ) Notice: Subject to any disclaimer, the term of this patent is extended or adjusted under 35 U.S.C. 154(b) by 4 days.

(21) Appl. No.: 16/182,339

(22) Filed: Nov. 6, 2018

(65) Prior Publication Data

US 2019/0137226 A1 May 9, 2019

Related U.S. Application Data

(60) Provisional application No. 62/581,982, filed on Nov. 6, 2017.

(51) Int. Cl.
*F41J 1/00* (2006.01)
*F41J 9/14* (2006.01)

(52) U.S. Cl.
CPC .. *F41J 1/00* (2013.01); *F41J 9/14* (2013.01)

(58) Field of Classification Search
CPC ..... F41J 3/00; F41J 1/00; F41J 9/14
See application file for complete search history.

(56) References Cited

U.S. PATENT DOCUMENTS 738,790 A * 9/1903 Gaudet ..... A63F 9/0208 273/409
5,649,706 A * 7/1997 Treat, Jr. ..... F41J 9/14 273/358
6,269,581 B1 * 8/2001 Groh ..... F41G 1/38 42/122
7,134,663 B1 * 11/2006 Lowe ..... F41J 3/0004 273/403

(Continued)

OTHER PUBLICATIONS

Hoppe's, Hoppe's No. 9 Critter Target Paper, Big Buck and Deer (Pack of 5), Amazon.com, accessed on Nov. 5, 2018, published in the United States at https://www.amazon.com/hoppes-critter-paper-targets-28x28-inch/dp/b000h6r082.

(Continued)

*Primary Examiner* — David L Lewis
*Assistant Examiner* — Shauna-Kay Hall
(74) *Attorney, Agent, or Firm* — Perkins Coie LLP

(57) ABSTRACT

An apparatus for generating a vitals target may include a processor, an output device, and a non-transitory storage medium. The output device is communicatively connected to the processor. The non-transitory storage medium may include a number of module. The number of modules may include a target distance identify module, a target animal identify module, a vital zone determine module, a first distance identify module, and a target calculate module. The target distance identify module that identifies a target set distance for a target configuration. The target animal identify module identifies an animal being simulated. The first distance identify module identifying a first distance being (Continued)

simulated at the target set distance. The target calculate module rendering the vital zone for a target distance. The output generate module causing the output device to generate a vitals target.

17 Claims, 19 Drawing Sheets

(56) References Cited

U.S. PATENT DOCUMENTS

| | | | | |
|---|---|---|---|---|
| 2002/0113372 | A1* | 8/2002 | Love | F41J 1/00 273/408 |
| 2004/0016168 | A1* | 1/2004 | Thomas | G02B 27/32 42/122 |
| 2006/0257825 | A1 | 11/2006 | Jennings | |
| 2008/0054570 | A1* | 3/2008 | Potterfield | F41J 5/24 273/403 |
| 2013/0040268 | A1* | 2/2013 | Van der Walt | F41J 5/02 434/16 |

OTHER PUBLICATIONS

Chuck Hawks,The Kill Zone of North American Big Game Animals, chuckhawks.com, accessed on Nov. 5, 2018, published in the United States at https://chuckhawks.com/kill_zone_game_animals.htm.

* cited by examiner

Target Generator
100

Target Generator
100

APPARATUS FOR GENERATING A VITALS TARGET

TECHNICAL FIELD

The disclosure relates generally to an apparatus for generating targets; specifically, an apparatus generating vitals targets that measure accuracy for a plurality of different distances.

BACKGROUND

Marksmanship is vital in a number of different sports. Whether it be hunting, shooting, air guns, or archery, marksmanship is used to measure skill and prowess. Marksmanship is also used to prepare for ethical hunting expeditions.

Individuals practicing marksmanship may do so at a practice range allowing for practice at a known distance. Practice ranges may not include the distance required during a hunting expedition. Individuals may estimate the skill needed for an ethical hunting expedition as it correlates to the distance available for a practice range.

When an individual is not sufficiently practiced to be accurate at the distance used in the hunting expedition the animal hunted may not be ethically harvested.

BRIEF SUMMARY

An apparatus for generating a vitals target may include a processor, an output device, and a non-transitory storage medium. The output device is communicatively connected to the processor. The non-transitory storage medium may include a number of modules. The number of modules may include a target distance identify module, a target animal identify module, a vital zone determine module, a first distance identify module, and a target calculate module. The target distance may identify module that identifies a target set distance for a target configuration. The target animal identify module may identify an animal being simulated. The vital zone determine module may determine the shape of a vital zone. The first distance identify module may identify a first distance being simulated at the target set distance. The target calculate module may render the vital zone for a target distance. The output generate module may cause the output device to generate a vitals target.

A computer program product for generating a vitals target on a device is disclosed. The computer program product may include a memory resource. The memory resource may include computer program code to cause a computer to perform a particular operation. The memory resource may include a target distance identifier, a target animal identifier, a vital zone determiner, a first distance identifier, a second distance identifier, a direction determiner, a target calculator, a trajectory calculator, and an output generator. The target distance identifier may cause the device to identify a target set distance for a target configuration. The target animal identifier may cause the device to identify an animal being simulated. The vital zone determiner may cause the device to determine the shape of a vital zone. The first distance identifier may cause the device to identify a first distance being simulated at the target set distance. The second distance identify module may cause the device to identify a second distance being simulated. The direction determiner may cause the device to simulate a rotation of a vital zone to simulate an animal standing at a determined angle. The target calculator may cause the device to render the vital zone for a target distance. The trajectory calculator may cause the device to calculate a trajectory of a projectile. The output generator may cause the device to generate a vitals target.

An apparatus for training marksmanship is disclosed. The apparatus may include a vitals target. The vitals target may include an image of an animal, a number of vital zones, and a number of amulets. The image of an animal indicating an animal that may be hunted is disclosed. Each of the plurality of vital zones indicates the vital zone of an animal to strike for a humane hunt. The amulets may be the area between two vital zone outlines. The amulets may represent the difference in grouping size used for an ethical hunt.

BRIEF DESCRIPTION OF THE DRAWINGS

A more particular description of the invention briefly described above is made below by reference to specific examples. Several examples are depicted in drawings included with this application. An example is presented to illustrate, but not restrict, the invention.

DETAILED DESCRIPTION

Figure 1:
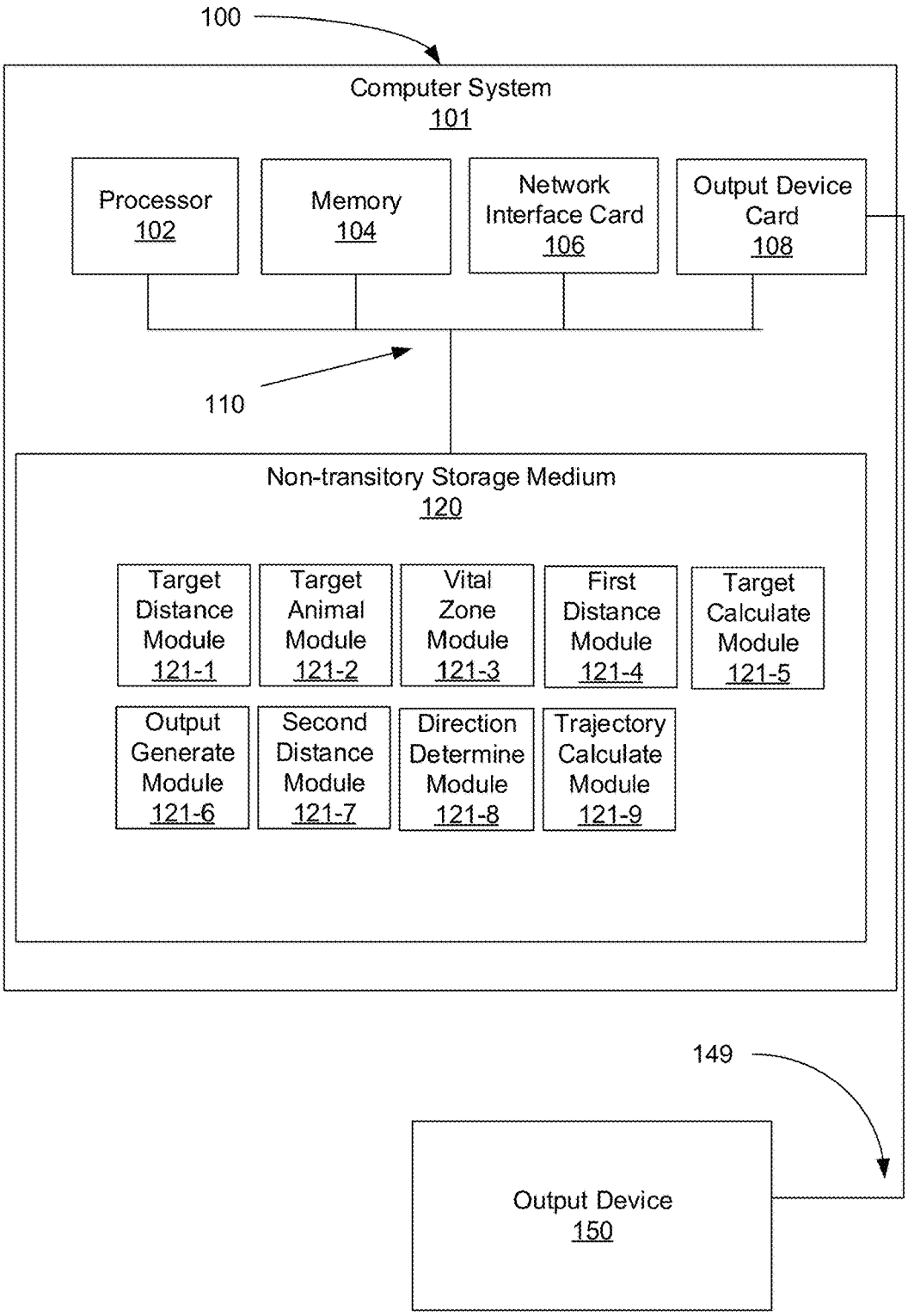
FIG. 1 illustrates an apparatus for generating vitals targets according to one example of the principles described herein.

A detailed description of the claimed invention is provided below by example, with reference to examples in the appended figures. Those of skill in the art will recognize that the components and steps of the invention as described by example in the figures below could be arranged and designed in a wide variety of different configurations, without departing from the substance of the claimed invention. Thus, the detailed description of the examples in the figures is merely representative of an example of the invention and is not intended to limit the scope of the invention as claimed.

In some instances, numerical values are used to describe features such as spreading factors, angle, trajectory, and distances. Though precise numbers are used, one of skill in the art recognizes that small variations in the precisely stated values do not substantially alter the function of the feature being described. In some cases, a variation of up to 50% of the stated value does not alter the function of the feature. Thus, unless otherwise stated, precisely stated values should be read as the stated number, plus or minus a standard variation common and acceptable in the art.

For purposes of this disclosure, the modules refer to a combination of hardware and program instructions to perform a designated function. Each of the modules may include a processor and memory. The program instructions may be stored in the memory and cause the processor to execute the designated function of the modules.

Identifying and targeting a vital zone is a valued skill for marksmen and hunters. The vital zone for any animal may be shaped in three dimensions. While the vital zone may be irregularly shaped, it may be represented by a circle, triangle, rectangle, oval, oblong, or other shapes including irregular shapes within the vital zone area that provides proper shot placement for an ethical hunt. Scoring of a target may include that all shots are placed within a vital zone.

A purpose of the claimed apparatuses, methods, and systems is to facilitate and enhance the use of a computing device. One example of the apparatus is a computer with a printer used to generate vitals targets that can be used at a marksmanship range when the apparatus is not present. Another example is a computer program product used to generate vitals targets that are used at a marksmanship range. Yet another example is an apparatus for training marksmanship that includes a target. The target includes an image of an animal, a plurality of vital zones, and a number of amulets. The target can be used at a known distance to simulate the accuracy needed for an ethical hunt at a different distance.

As used in the present specification, projectile refers to an object being propelled from a device, such as a firearm, air gun, or a bow and arrow, toward a target.

As used in the present specification, ammunition refers to a projectile, a powder charge, and an ignition source. When the ignition source is activated it ignites the powder charge which causes the projectile to be expelled from a firearm.

As used in the present specification, modern ammunition refers to ammunition that has a projectile, a powder charge, a case, and a primer. The primer is the ignition source for the powder that is activated by pressure. The primer ignites the powder charge. The ignited powder charge is contained by the case, causing the expanding gases to propel the projectile out of a firearm.

As used in the present specification and in the appended claims, ballistics coefficient refers to a numerical value effecting the flightpath of a projectile.

As used in the present specification and in the appended claims, vitals zone refers to a target area of an animal representing the vital organs. If the vital zone of an animal is hit by a projectile, it is most likely to cause the quick death of the animal which prevents the animal from suffering unnecessarily.

As used in the present specification and in the appended claims, muzzle refers to the end of a barrel of a firearm from whence a projectile is expelled.

As used in the present specification and in the appended claims, trajectory refers to the flightpath of a projectile between the time it is released from a device and its position during flight. The trajectory may be affected by the speed of the projectile, the ballistic coefficient, and gravity.

As used in the present specification and in the appended claims, a number refers to a whole number of the value one or greater, zero, not being a number, but rather being the absence of a number.

As used in the present specification and in the appended claims, plurality refers to two or more of an item.

As described above, an apparatus for generating a vitals target allows for a marksman to practice a plurality of distances at a shorter distance for receiving feedback as to the accuracy required for longer distance. Additionally, a marksman may measure improvement over time and identify a distance where the marksman can engage in an ethical hunt. By being able to readily practice a variety of distances and vital targets, marksmen may improve their skill for ethical hunting. Ethical hunting may improve the survival rates of a number of species effected by ethical hunts. An ethical hunt may reduce the burden of one species on an area of land, which allows for other species to flourish. An ethical hunt may be used to reduce predators in an area, allowing an endangered species to grow and populate an area.

For example, if there are too many deer in an area, the deer may over consume vegetation resulting in insufficient vegetation for other species. Additionally, the overconsumption of vegetation may cause the deer in an area to become ill or sickly due to the unavailability of food. The overconsumption of vegetation may cause erosion due to the lack of vegetation, which may have permanent and lasting effects on land usage. An ethical hunt may control the population of the species, to allow other species, and/or even that species to populate the area.

Marksmen may find it easier to practice accuracy and learn vital targets at a structured shooting range, where marksmanship is practiced and measured under known conditions and known distances. A marksman may choose the practice arena, as it allows for greater frequency of shots and better feedback on each individual shot. Thus, over time a marksman may improve faster in a structured practice area than in a hunt. Additionally, a marksmen that engages in practice is less likely to cause pain and suffering for an animal through a missed or poorly placed shot.

Additionally, some marksmen prefer to show off their accuracy and prowess without engaging in hunting. Such simulated activities may provide for entertainment and enjoyment while measuring a valuable skill, whether or not that skill is actually used in hunting.

Referring now to the figures, FIG. 1 illustrates an apparatus for generating a vitals target. The target generator (100) includes a computer system (101) communicatively connected using a communication cable (149) to an output device (150). In some embodiments a wireless connection is used instead of a communication cable (149).

The computer system (101) may include a processor (102), memory (104), a network interface card (106), and an output device card (108) that are communicatively connected through a communication bus (110) with a non-transitory storage medium (120).

The non-transitory storage medium (120) may include a number of modules (121). The number of modules may include a combination of software, hardware, or both to perform a particular task. In this example, the non-transitory storage medium (120) may include a target distance module (121-1), a target animal module (121-2), a vital zone module (121-3), a first distance module (121-4), a target calculate module (121-5), an output generate module (121-6), a second distance module (121-7), a direction determine module (121-8), and a trajectory calculate module (121-9).

The target distance module (121-1) calculates a distance at which the vital zone target may be used at. The target distance module may generate a target based on a common distance for practicing marksmanship. For example, in handgun marksmanship, popular distances may include 7 yards, 10 yards, 15 yards, 17 yards, or 25 yards. Similar distances may be calculated using metric values. In another example, in rifle marksmanship popular distances may include 25 yards, 50 yards, 100 yards, and 200 yards. The target distance module (121-1) identifies one target distance where the target is designed to be used.

The target animal module (121-2) identifies an animal for which a vital zone will be selected. For example, the target animal module (121-2) may identify a wild boar as the target animal. In another example, the target animal module (121-2) may identify an elk, deer, bear, turkey, elephant, lion, mountain lion, or other animal which may be targeted.

The vital zone module (121-3) identifies the vital zone of the animal identified by the target animal module (121-2). Each animal may have a different vital zone. Further, the vital zone may actually be representative of a three-dimensional space in the animal where the vital organs are most likely to be. Identifying the vital zone may require identifying an angle at which the target animal may be presenting itself in relationship to the marksman. The vital zone module (121-3) may use infrared sensors to determine the vital zone based on heated areas of an animal. A three-dimensional vital zone may be represented in two dimensions by showing the outline of the vital zone from a desired perspective.

The first distance module (121-4) may identify a first distance to be emulated at the target distance. For example, a target distance of 50 yards may be identified. The first distance module (121-4) may identify a target distance of 100 yards. The target generator (100) may then use various calculations to represent the accuracy needed at 50 yards in order to hit the vitals zone at 100 yards.

The target calculate module (121-5) may calculate the size of the target based on a combination of the target distance, the vital zone, and the direction an animal is being emulated stand. The target calculate module (121-5) may consider the trajectory of a projectile in identifying the target size.

The target calculate module (121-5) may calculate the size of the target at the by taking a point from whence the projectile may be released to a figurative vital zone target at the simulated distance. Geometric calculations may then measure the angle from the point of release to the outer edges of a two-dimensional vital zone. Mathematical formulas, such as the Pythagorean Theorem may be used to calculate the size of the target at the target distance.

The output generate module (121-6) may create output that a marksman may use for marksmanship practice. In one example, the output generate module (121-6) may cause a printer associated with the computer system (101) to print a target that may be used by the marksman. In another example, the output generate module (121-6) may control an input and output device that causes a target to be projected in front of a marksman while measuring a simulated projectile from the marksman. In yet another example, the output generate module (121-6) may control an output device that projects a virtual target in front of the marksman. A sensor may be used to read where an actual projectile from the marksman strikes the projected target.

A second distance module (121-7) may calculate a second distance for which a vital zone may be represented on a single target. For example, a target distance of 50 yards may have a vital zone presentation for both 50 yards and 100 yards. Additional distances may be identified by the second distance module (121-7).

A direction determine module (121-8) may determine the presentation direction of a target animal in relation to the marksman. The direction the animal is facing may determine the two-dimensional shape of the vital zone as presented to the marksman. For example, the direction determine module (121-8) may determine that an animal is looking straight at the marksman. The animal looking straight at the marksman may present a particular shape of the vital zone. In another example, the animal is facing away from the marksman at a 90° angle in what is called a broadside shot. This may present a different shape of the vital zone.

The target generator (100) may use a trajectory calculate module (121-9) which considers the trajectory of a projectile. The trajectory calculate module (121-9) may consider the variance in angle from which a projectile is expelled. The trajectory calculate module (121-9) may consider the ballistic coefficient of the projectile. The trajectory calculate module (121-9) may consider the effects of gravity on the projectile over time during the flight of the projectile.

An overall example according to FIG. 1 will now be given. A target distance is identified by the target generator (100) using the target distance module (121-1). A target distance of 50 yards is identified.

A target animal is identified by the target generator (100) using the target animal module (121-2). A target animal of a male white-tail deer is identified.

A vital zone is identified by the target generator (100) using the vital zone module (121-3). A three-dimensional understanding of the vital zone of a male white-tail deer may be identified.

A first distance iat the first distance when being shot at the target distance. The first distance may be the target distance or the first distance may be different than the target distance. In this example, the first distance module (121-4) identifies 50 yards as the first distance being simulated.

A second distance is identified by the target generator (100) using the second distance module (121-7) to determine the size of the vital zone as though the vital zone is at the second distance when being shot at the target distance. In this example, the second distance module (121-7) identifies 100 yards as the second distance being simulated.

A direction of the target animal may be identified by the target generator (100) using a direction determine module (121-8). In this example, the direction determine module (121-8) identifies that the animal is facing to the right of the marksman, providing a broadside shot.

A projectile trajectory may be calculated by the target generator (100) using the trajectory calculate module (121-9). The projectile trajectory may be used in calculating the size and placement of the target.

A target shape and size may be determined using the target calculate module (121-5). In this example, the target calculate module calculates a vital zone target for 50 yards and 100 yards as sized to be aimed at 50 yards. The projectile trajectory may be used to place the targets to account for the gravitational drop and projectile angle as varied between 50 yards and 100 yards.

Figure 2:
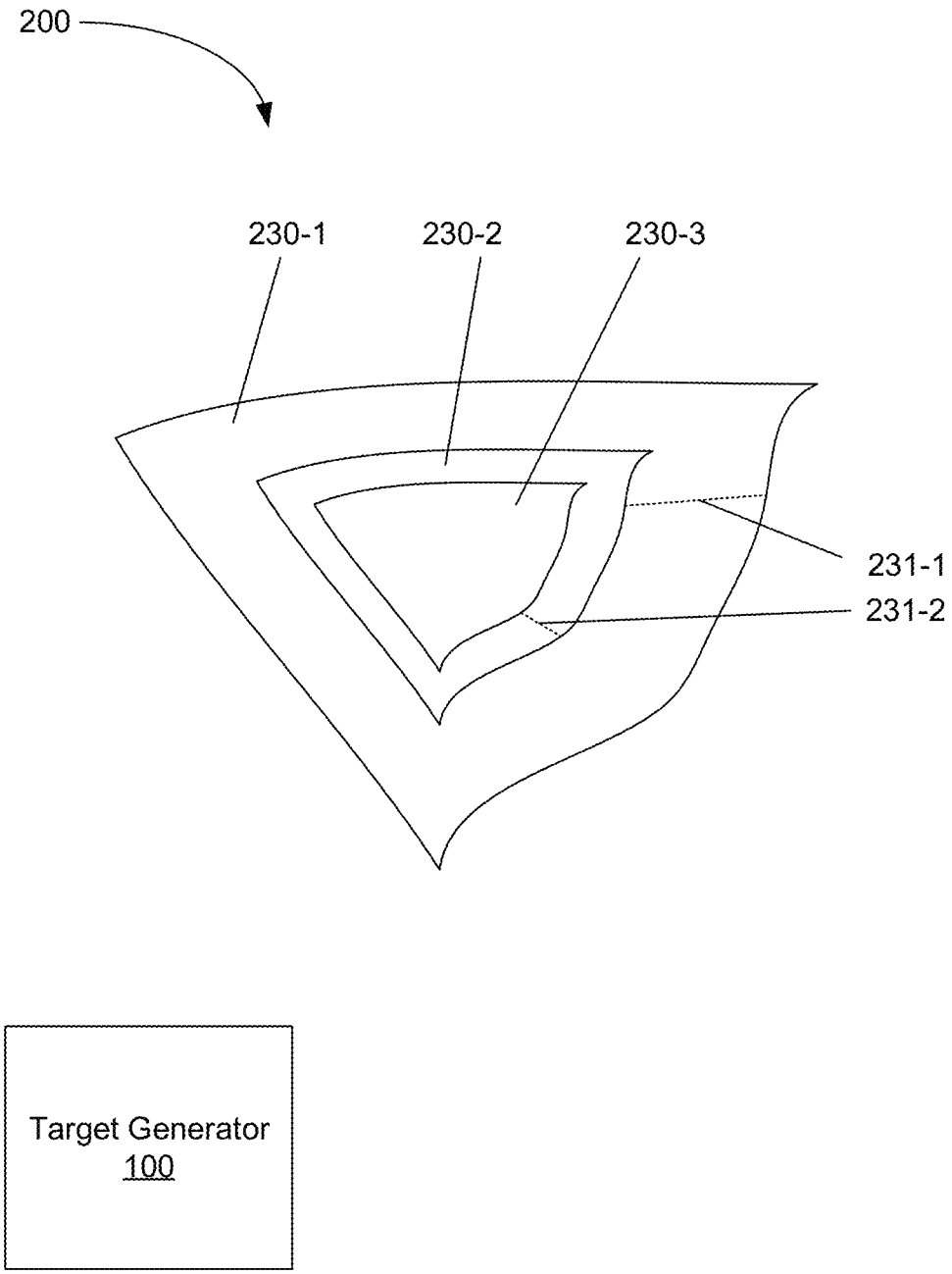
FIG. 2 illustrates an apparatus for training marksmanship including a plurality of vital zones according to the principles described herein.

FIG. 2 illustrates a vital zone target (200) that may be created by a target generator (100), according to one example of the principles described herein.

In this example, a number of vital zone targets (2300) are illustrated. In this example, the vital zone targets (2300) are concentric and may represent the accuracy needed by a marksman to hit a vital zone at a given distance. The area between vital zones may be referred to as an amulet. The size of the amulet may be measured in the distance between a plurality of vital zones. The distance between vital zones may vary significantly depending on the distance the vital zone represents. An overall example using FIG. 2 will now be given.

Each of the vital zone targets (2300) may represent a vital zone at a given distance. In this example, the vital zone target (2300) is being presented at 25 yards. The first vital zone (230-1) may represent the vital zone at 25 yards. The second vital zone (230-2) may represent the accuracy needed by the marksman for an effective shot at 50 yards. The difference in the targets may create an amulet distance (231-1) that represents the increased accuracy needed to hit the vital zone target (2300) at the longer distance.

The third vital zone (230-3) may represent the vital zone at 100 yards. The amulet distance (232-2) between the second vital zone (230-2) and the third vital zone (230-3) may represent the increased accuracy needed to strike the vital zone at 100 yards.

Figure 3:
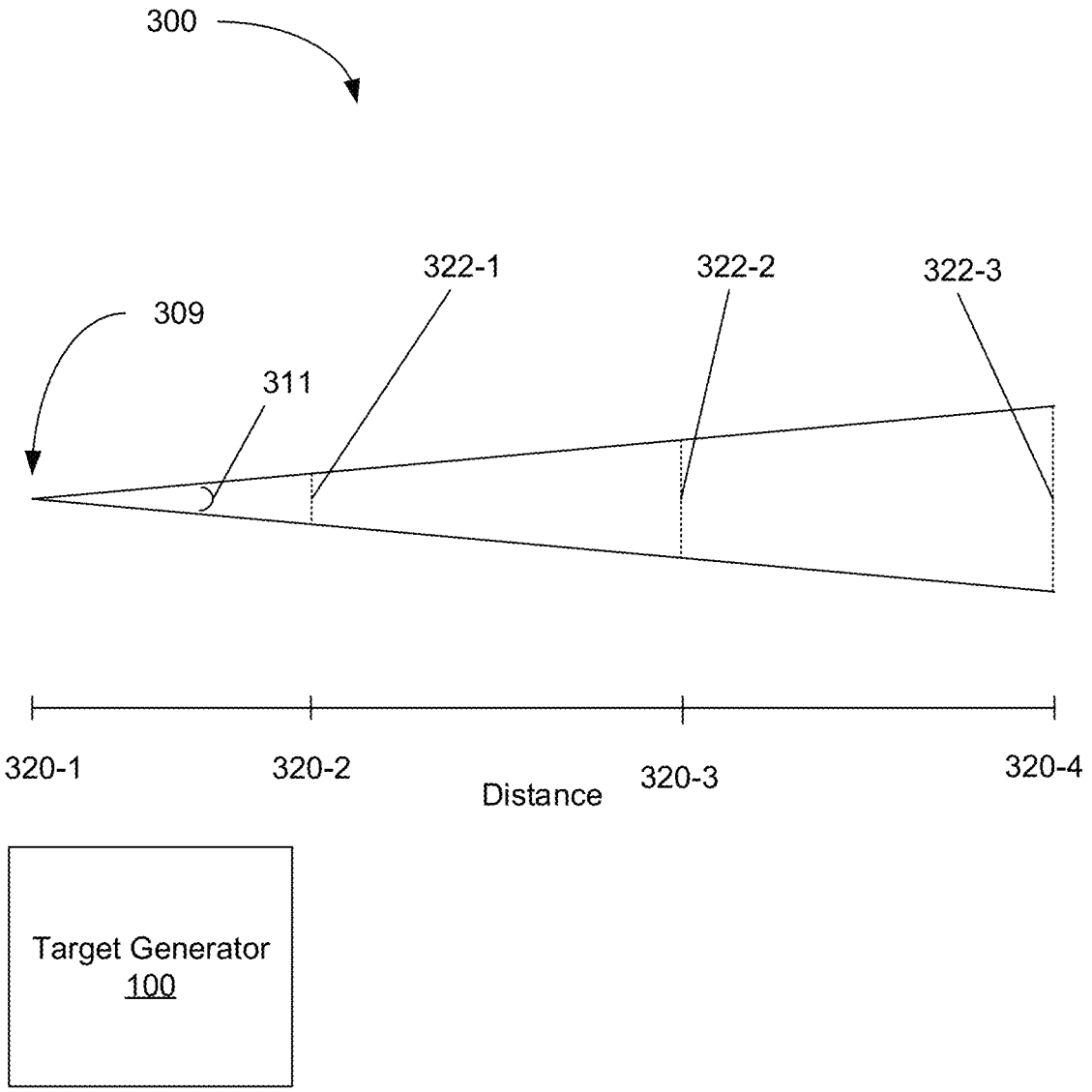
FIG. 3 illustrates trajectory calculations that may be used by a target generator.

FIG. 3 illustrates an example (300) of the effect of an angle at the marksman's release and its effect on accuracy over distance. As described here, the marksman will be described using a firearm. Similar effects are used in other projectile devices, such as air guns, bows and arrows, and throwing objects.

The shooting position (309) may represents the barrel of a firearm. The path of the projectiles may be determined by slight variances in the barrel and the muzzle of the firearm. Minor variances at the shooting position (309) may have significant effects over a long distance. For example, a non-discernible variation in the shooting position may be unmeasurable at 7 yards, but may provide for a target miss at distances over 1000 yards.

The angle of movement (311) of the shooting position (309) may cause these variations. The angle of movement is a two-dimensional angle that includes both left and right and up and down components. One may think of the angle of movement as creating a cone in which the projectile will travel when released. Marksmen spend a great deal of time and effort reducing the size of the angle of movement (311). Additionally, the device used, such as a firearm, may affect the angle of movement. Some marksmen will expend significant time, money, and resources minimizing the angle of movement.

The measurement of the angle of movement may be measured in minute of angle, or MOA. An MOA represents a movement of 1/60th of a degree.

At close distances, the angle of movement may have minor effects. For example the size of the target zone at a known first distance (320-2) may create a target zone (322-1). At a longer distance (320-3), a larger target zone (322-2) occurs. At a still longer distance (320-4) an even larger target zone (322-3) occurs.

Figure 4A:
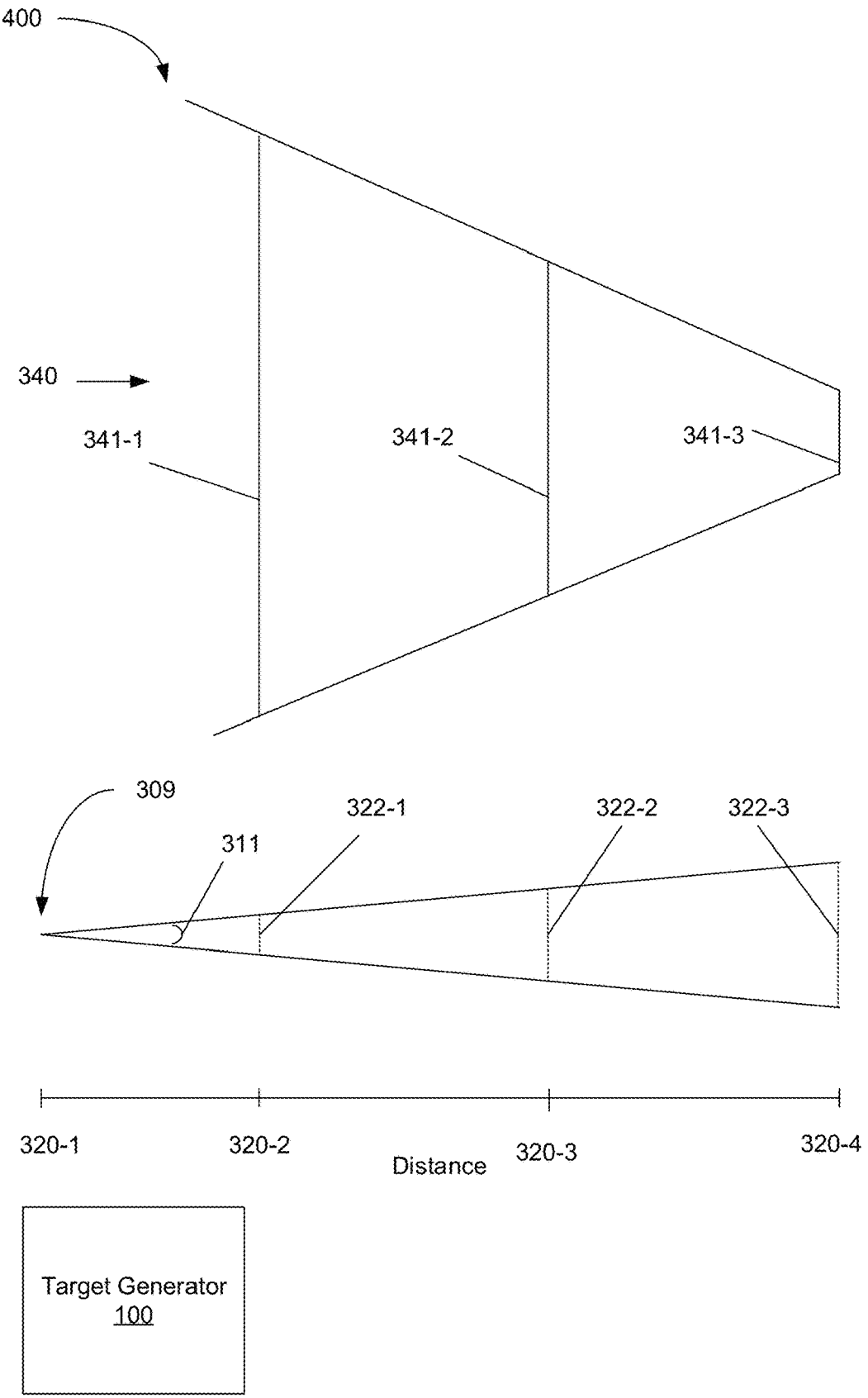
FIG. 4A illustrates trajectory calculations that may affect the size of a vitals target at a distance.

FIG. 4A is an illustration (400) of the effect of the angle of movement (311) over various distances as it relates to accuracy. The size of a target (340) may vary the accuracy needed depending on the distance the target is presented at. For example, to hit a target of a specified size at a first distance (320-2) may allow for a variance creating a large target (341-1). At a longer distance (320-3), the target may present as being smaller (341-2), requiring more accuracy. At the longest distance (320-4) the target presents as being smaller (341-3) requiring the most accuracy to hit.

Figure 4B:
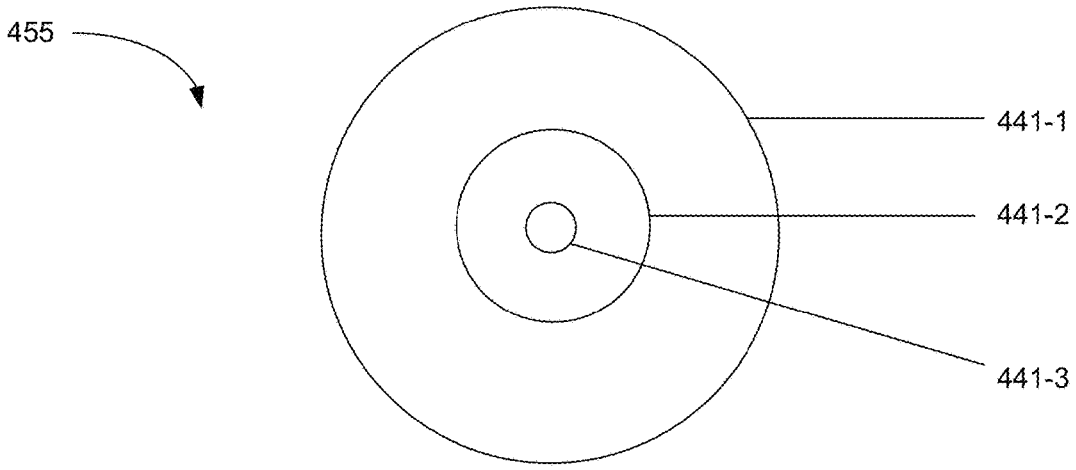
FIG. 4B illustrates the effects of trajectory calculations on the size of a vitals target.
Figure 4B:
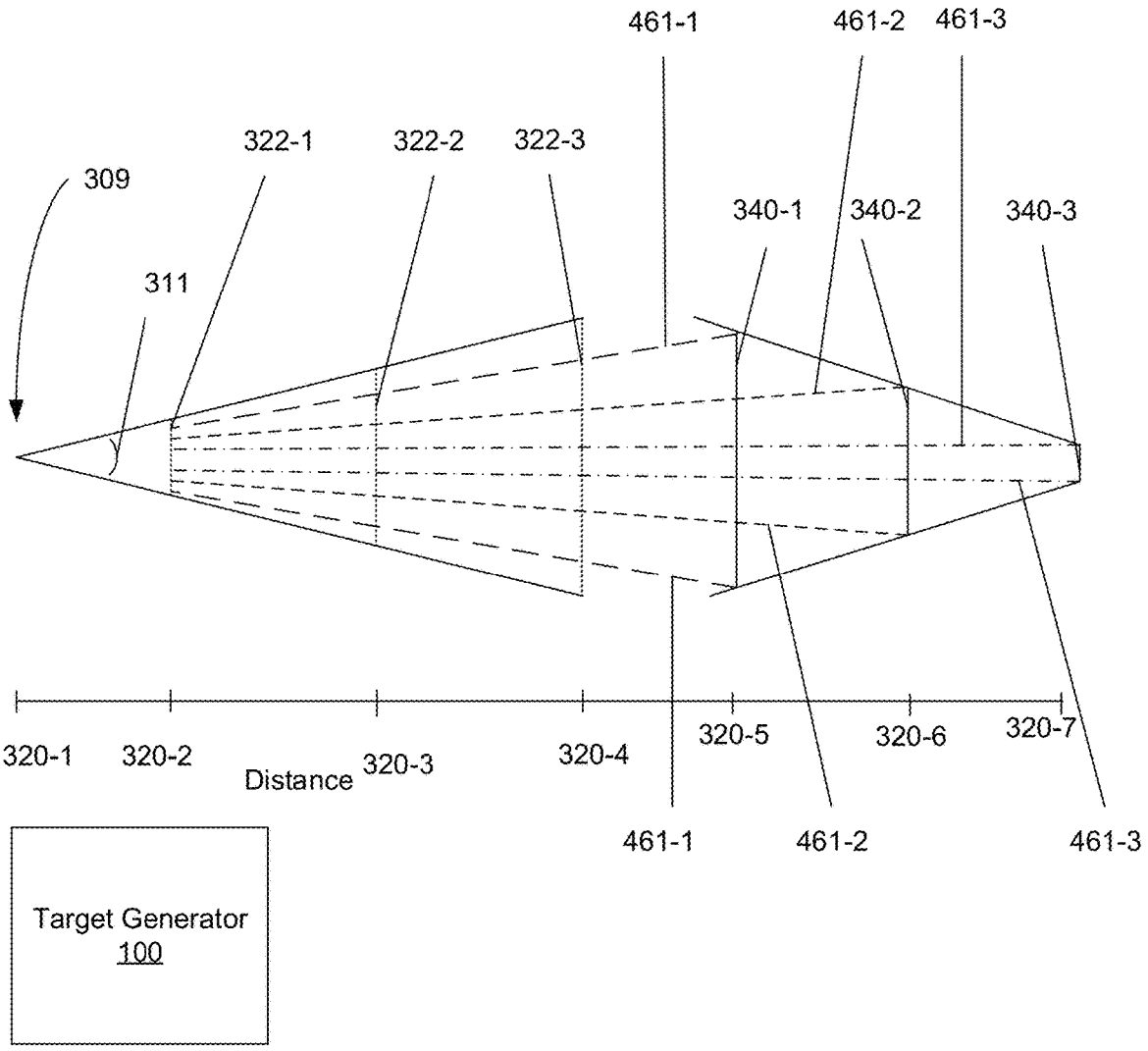

FIG. 4B is an illustration (455) of the effects of distance on the accuracy needed to strike a target of a particular size. Here the shooting position (309) and angle of movement (311) create variances in a trajectory path. In simulating a constant size target at varying distances, different levels of accuracy are required. Accuracy can be determined by controlling the angle of movement (311). In this example for a first distance (320-5) the angle of movement may be restricted to keep the projectile within a target zone (461-1). In order to hit the target at this first distance (320-5) at a first target (340-1) a smaller placement of projectiles is required. In order to hit this first target (340-1) the angle of movement (311) maybe restricted to be within a target zone (461-1). In order to hit the target at a second distance (320-6) a second target (340-2) is identified. In order to hit the second target (340-2) the angle of movement is restricted to be within a second path (461-2). In order to hit the target at a third distance (320-7) a third target (340-3) is identified. In order to hit the third target (340-3) the angle of movement is restricted within a third path (461-3).

The first target (340-1), second target (340-2), and third target (340-3) may be presented as shaded or line art on paper for a target. In this example the outline of the first target (340-1) is illustrated as a ring (441-1). The outline of the second target (340-2) corresponds to a different ring (441-2). The outline of the third target (340-3) corresponds to yet a different ring (441-3). The number of rings create a number of amulets, which may have different distances between them. The different distances represent the improved level of accuracy necessary to strike the fixed size target at the varying distances. Additionally, the rings may or may not be circular, but may also represent the outline of the vital zone that has been selected by the target generator (100). The rings may be a circle, triangle, rectangle, oval, oblong, or other geometric shapes including irregular shapes.

Figure 5:
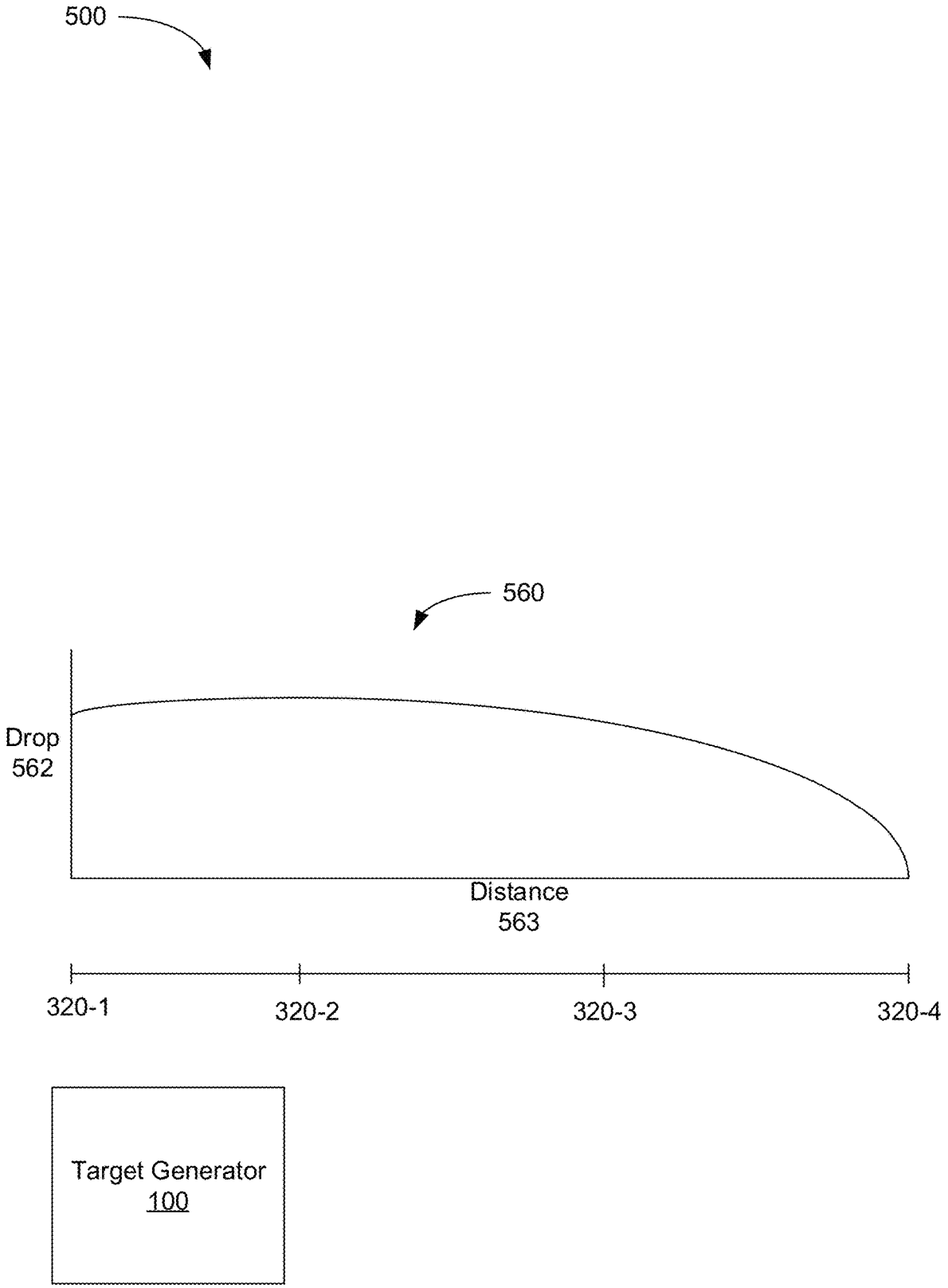
FIG. 5 illustrates a flightpath of a projectile over distance as may be used in calculations by a target generator.

FIG. 5 is an illustration (500) of a trajectory of a projectile as used by the target generator (100). A first distance (FIG. 3, 320-1) represents a shooting position (FIG. 3, 309) of a marksman. The shooting position (FIG. 3, 309) represents a zero distance or a distance where the projectile has not traveled. The zero distance is the origin of the projectile on the path. As the projectile travels, there may be a slight rise in the projectile due to the angle at which the projectile is released within the angle of movement (FIG. 3, 311). An intentional rise in the projectile may be created, in order to account for the placement of the shooting position (FIG. 3, 309) in relation to the target. The intentional rise may be used to overcome or compensate for the effects of gravitational pull on the projectile. As the distance increases, the projectile may drop due to the effects of the gravitational force on the projectile.

The target generator (100) may consider the effects of the trajectory and drop of the projectile in creating the vital zone target (2300).

Figure 6A:
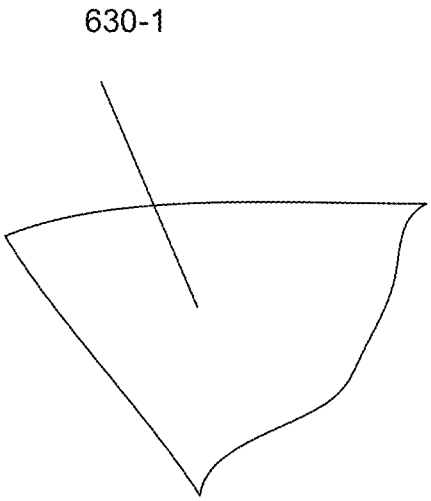
FIGS. 6A, 6B, and 6C illustrate the shape of a vital zone which is rotated as though an animal were standing at a different angle from the marksman.
Figure 6B:
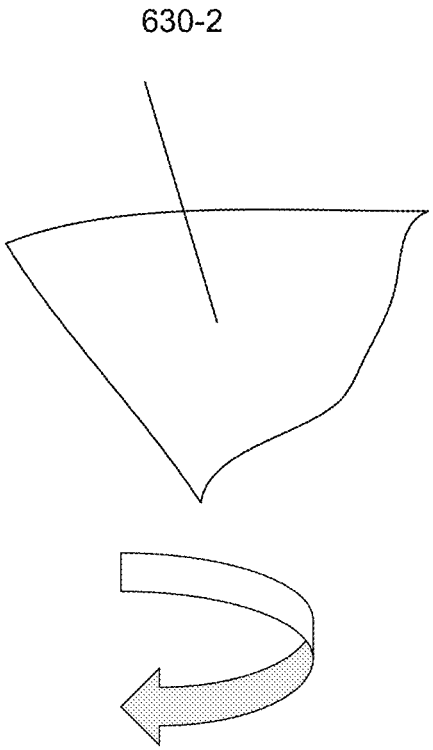
Figure 6C:
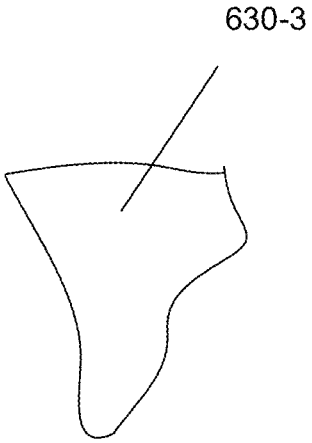

FIGS. 6A, 6B, and 6C represent a vital zone (630) as it may be rotated, based on the presentation of the animal in relationship to the marksman. As illustrated in FIG. 6A represents a broad sideview of the vital zone (630-1). FIG. 6B represents that the vital zone (630-2) is going to be rotated in a counterclockwise rotation on a vertical axis. After a rotation of 90° the vital zone (630-3) may appear as a different shape, as illustrated in FIG. 6C. The vital zone is a three-dimensional area within an animal that may present with a different outline depending on the position of the animal in relationship to the marksman. In illustrating the vital zone target (2300) it may be the outline of the vital zone in the presentation of that vital zone to the marksman.

Figure 7:
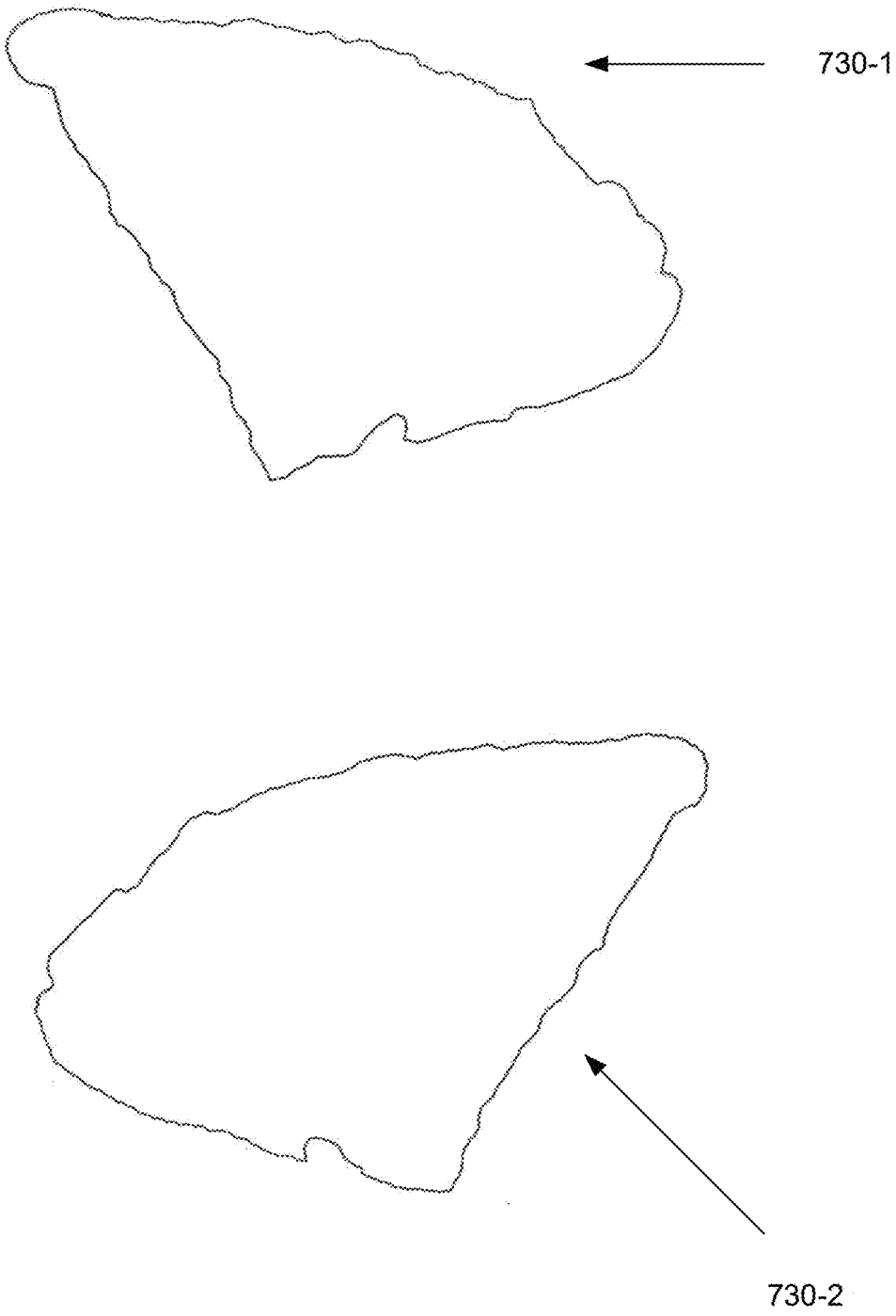
FIG. 7 illustrates a right side and a left side of a vitals target as may be represented by a target generator.

FIG. 7 represents the presentation of the vital zone to a marksman from different angles. In this example, when the animal is facing to the right a first vital zone target (730-1) is presented. When the animal is facing to the left, a second vital zone target (730-2) is presented. Due to the three-dimensional nature of the vital zone, the shape of the vital zone varies depending on the presentation of the animal to the marksman.

Figure 8:
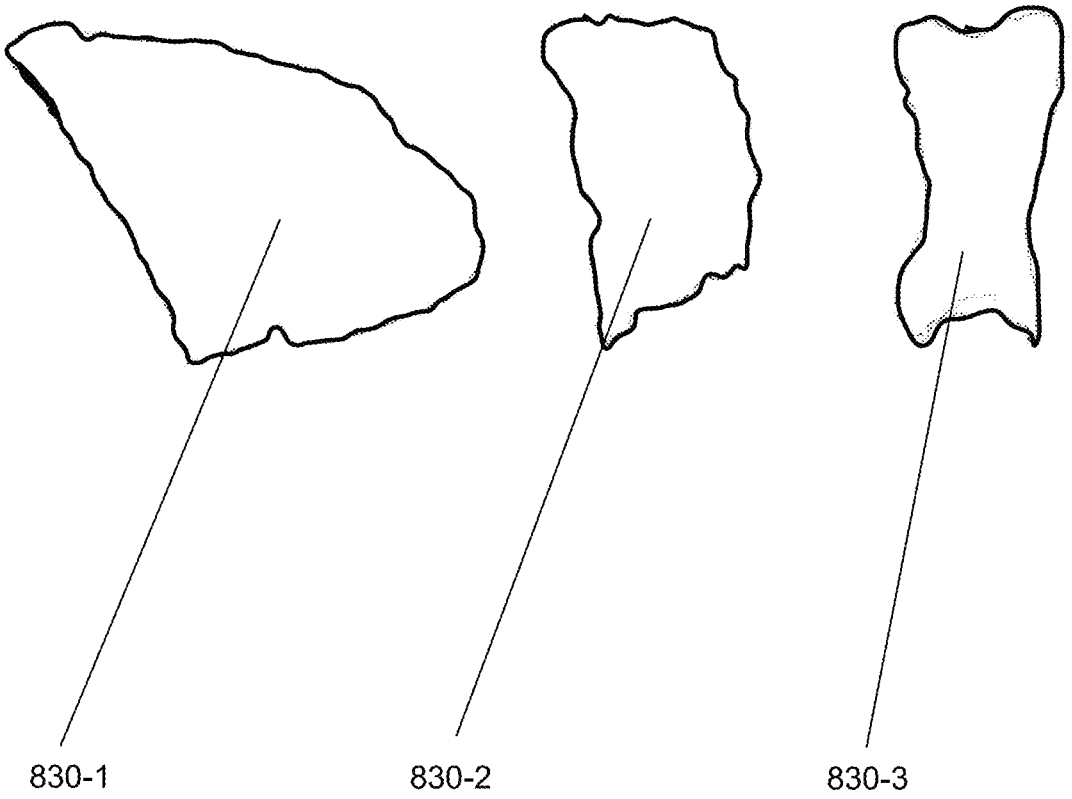
FIG. 8 illustrates the shape of a vitals target from different angles.

FIG. 8 represents an illustration of the vital zone as the presentation of the animal in relationship to the marksman varies. In this example, a first vital zone (830-1) represents a broad side view of the vital zone of the animal in relationship to the marksman. A second vital zone (830-2) represents the outline of the vital zone as the animal is facing at a 45° angle toward the marksman. This shows the variation in the presentation of the vital zone depending on the presentation of the animal. The third vital zone (830-3) represents the presentation of the outline of the vital zone as the animal faces directly at the marksman. Understanding the shape of the vital zone and the ability of the marksman allows the marksman to better demonstrate their skills and to engage in a more ethical hunt, allowing for more humane treatment of the animal during the hunt.

Figure 9:
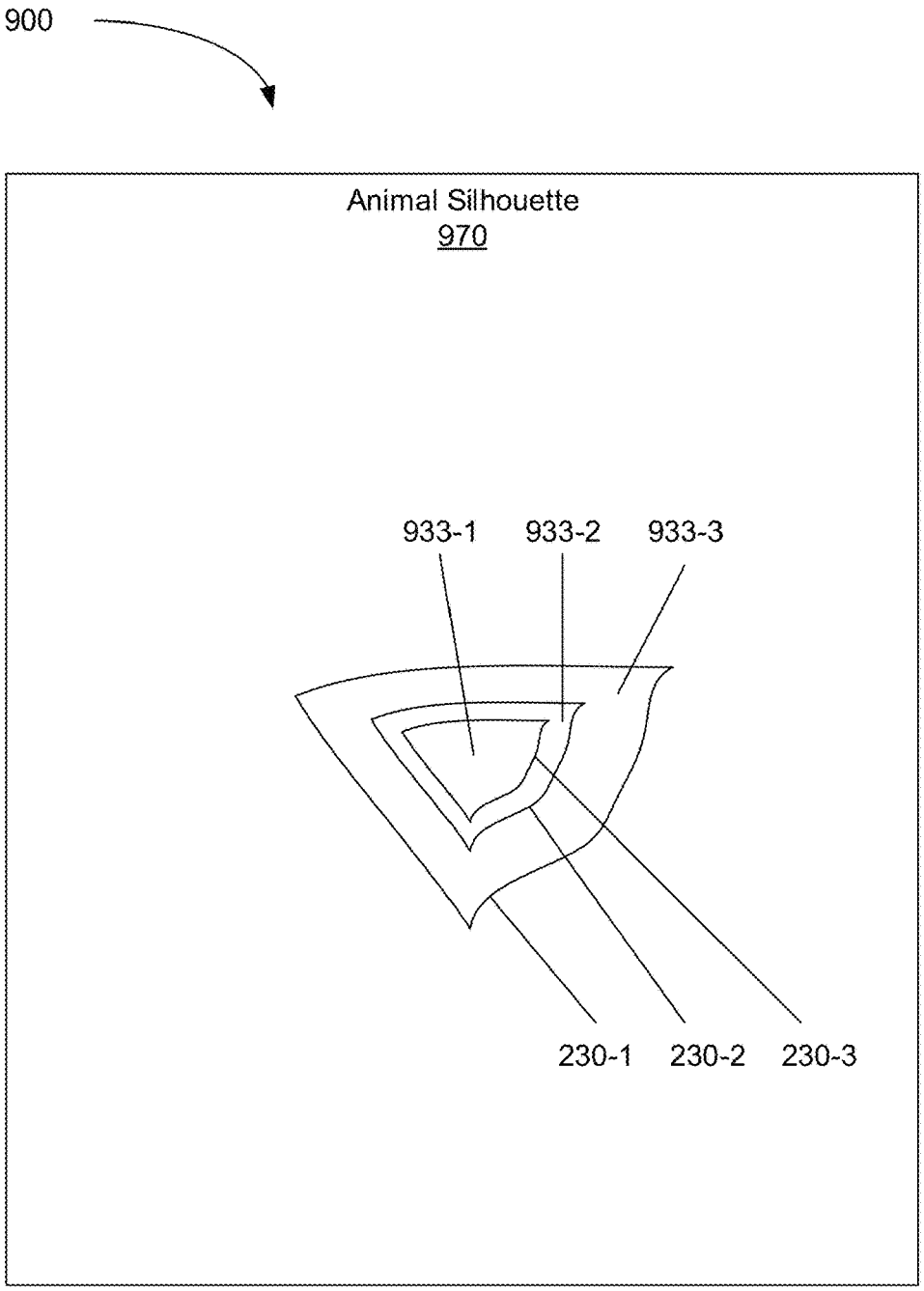
FIG. 9 illustrates an apparatus for training marksmanship according to one example of the principles described herein.

FIG. 9 represents an apparatus (900) for training marksmen. The apparatus includes an animal silhouette (970), a number of vital zones (230), and a number of amulets (933).

The animal silhouette (970) may be used to identify the vital zones (230) of the animal being targeted. The animal silhouette (970) may also illustrate the simulated angle of the animal in relationship to the marksman. The animal silhouette (970) may illustrate the placement of the vital zone (230) in relationship to the animal. The vital zone (230) may be to scale with the animal, or the animal may be at a different scale than the vital zone targets.

The number of amulets (933) may vary in size and area, based on the illustrated distance of the vital zones (230). The amulets (933) may be shaded or colored to illustrate which vital zone is appropriate for which distance.

Figure 10:
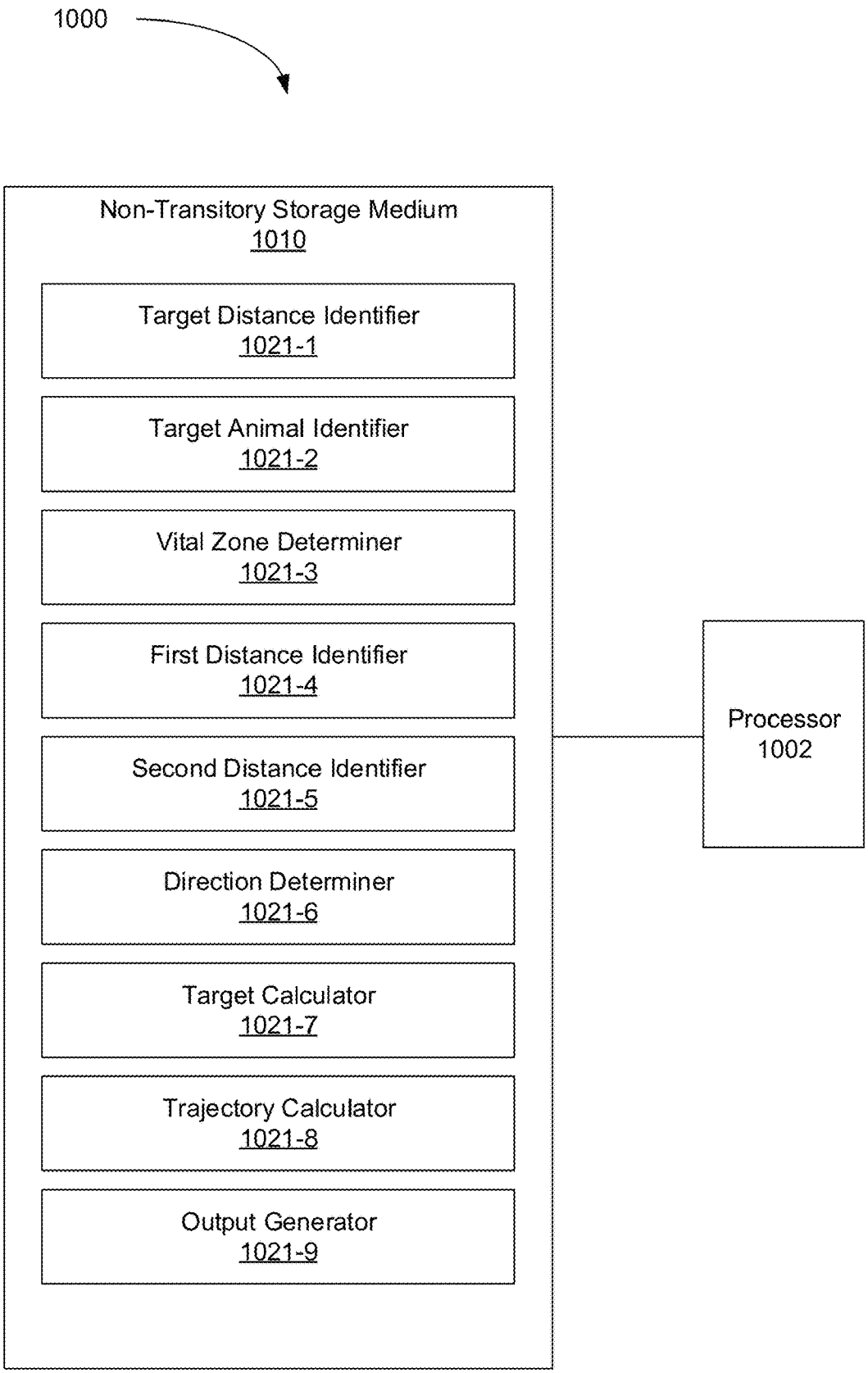
FIG. 10 represents a computer program product for generating vitals targets on a device.

FIG. 10 represents a computer program product (1000) for generating a vitals target (FIG. 2, 230) on a device. The computer program product (1000) includes a non-transitory storage medium (1010). The non-transitory storage medium includes a number of modules that, when executed by a processor (1002), cause a device to perform a particular task.

The non-transitory storage medium (1010) includes a target distance identifier (1021-1), a target animal identifier (1021-2), a vital zone determiner (1021-3), a first distance identifier (1021-4), a second distance identifier (1021-5), a direction determiner (1021-6), a target calculator (1021-7), a trajectory calculator (1021-8), and an output generator (1021-9).

The target distance identifier (1021-1) identifies a distance at which the target may be used at. The target distance will affect the size of the target presented to a user.

The target animal identifier (1021-2) identifies an animal for which a vital zone will be simulated.

The vital zone determiner (1021-3) identifies the three-dimensional attributes of the vital zone of the animal which will be simulated.

The first distance identifier (1021-4) identifies a first distance to be simulated at the target distance for the vital zone of the animal identified.

The second distance identifier (1021-5) identifies a second distance to be simulated at the target distance for the vital zone of the animal identified.

The direction determiner (1021-6) identifies the direction of the animal identified in relationship to the marksman that will be using the target. For example, the direction determiner (1021-6) may identify the animal as looking to the left, right, at a 45° angle, or straight at the marksman.

The target calculator (1021-7) calculates the shape of the vital zone at the angle determined for the animal identified at the distance simulated for the target distance.

The trajectory calculator (1021-8) may calculate the trajectory of a projectile to determine the placement of a number of vital zone targets.

The output generator (1021-9) causes the device to generate a vitals target. The output generator may generate a vitals target with a plurality of vital zones. The vital zones may have a plurality of different center points based on a trajectory calculation by the trajectory calculator (1021-8). The output generator may generate an overlay image of the animal corresponding to the vitals target. The overlay image may be used to identify the vitals target.

Figure 11:
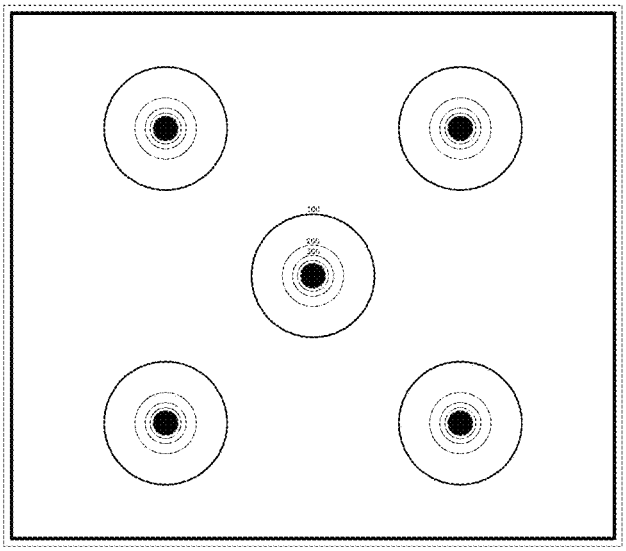
FIG. 11 illustrates a number of targets with a plurality of vital zones for different distances, according to one example of the principals described herein.

FIG. 11 represents a number of targets according to one example of the principals described herein. As illustrated, the target contains a number of individual targets. In this example, the target is configured for 75 feet, but includes vital zone indicators for 100, 200, 300, 400, 500, and 600 yards.

Figure 12:
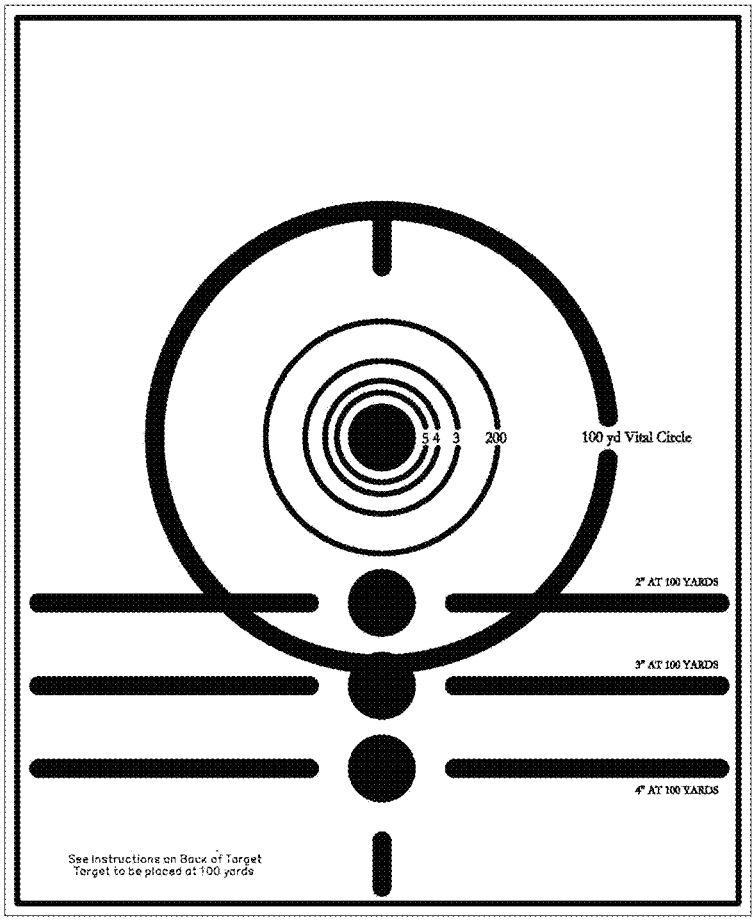
FIG. 12 illustrates a target with a plurality of vital zones for different distances according to one example of the principles described herein.

FIG. 12 represents a target according to one example of the principals described herein. In this example, the target is configured to be displayed at 100 yards. The target includes secondary targets to account for the trajectory of the projectile. Due to the gravitational effect on the projectile the marksmen may configure a rifle to strike the target high. In this example, secondary bullseyes are labelled for 2, 3 and 4 inches below where the projectile is expected to strike.

Figure 13:
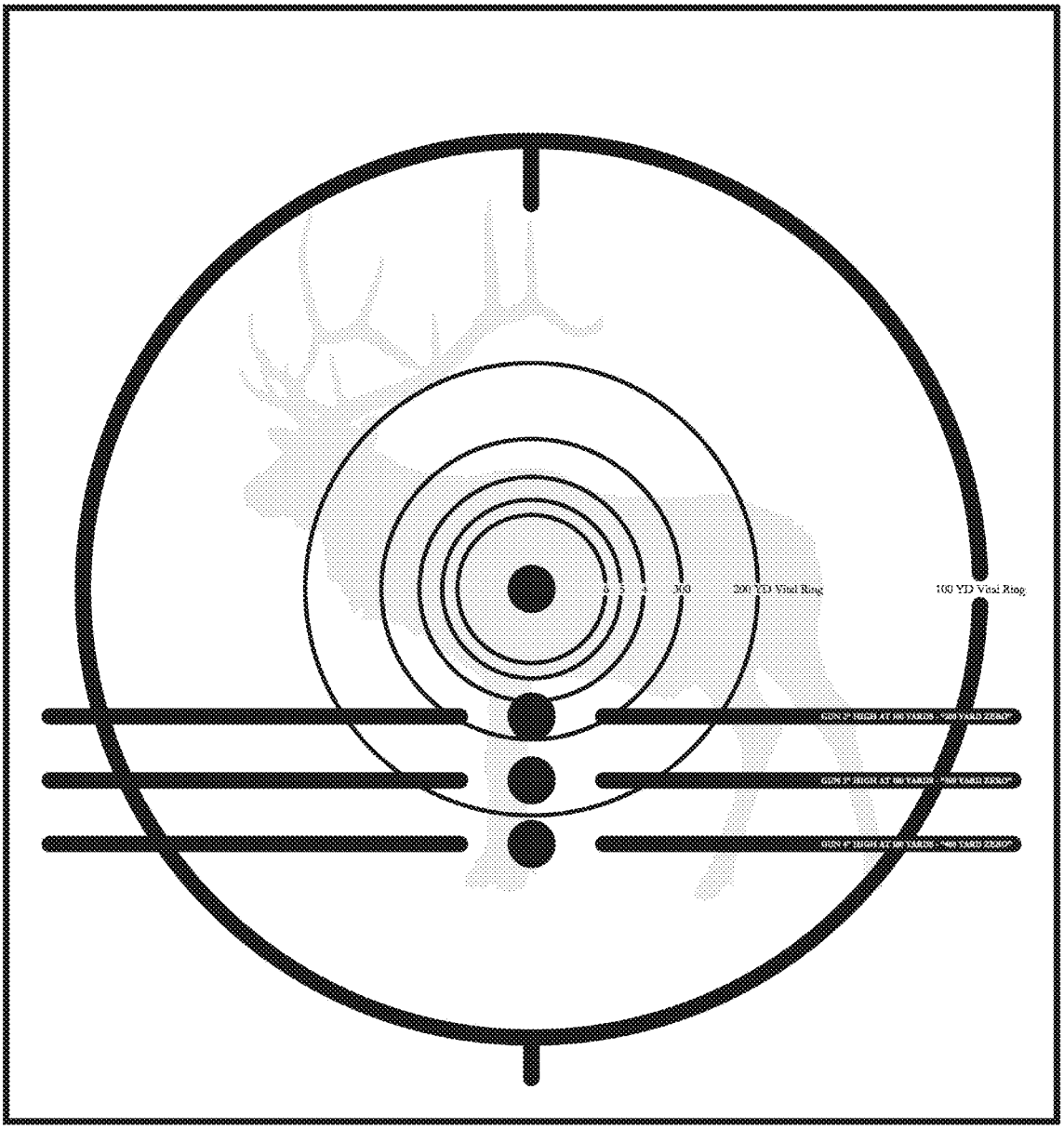
FIG. 13-16 represent a number of vital zone targets with identifying animals, according to one example of the principles described herein.

FIG. 13 represents a target of an elk according to one example of the principals described herein. In this example, the vital zone is sized for an elk and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 14:
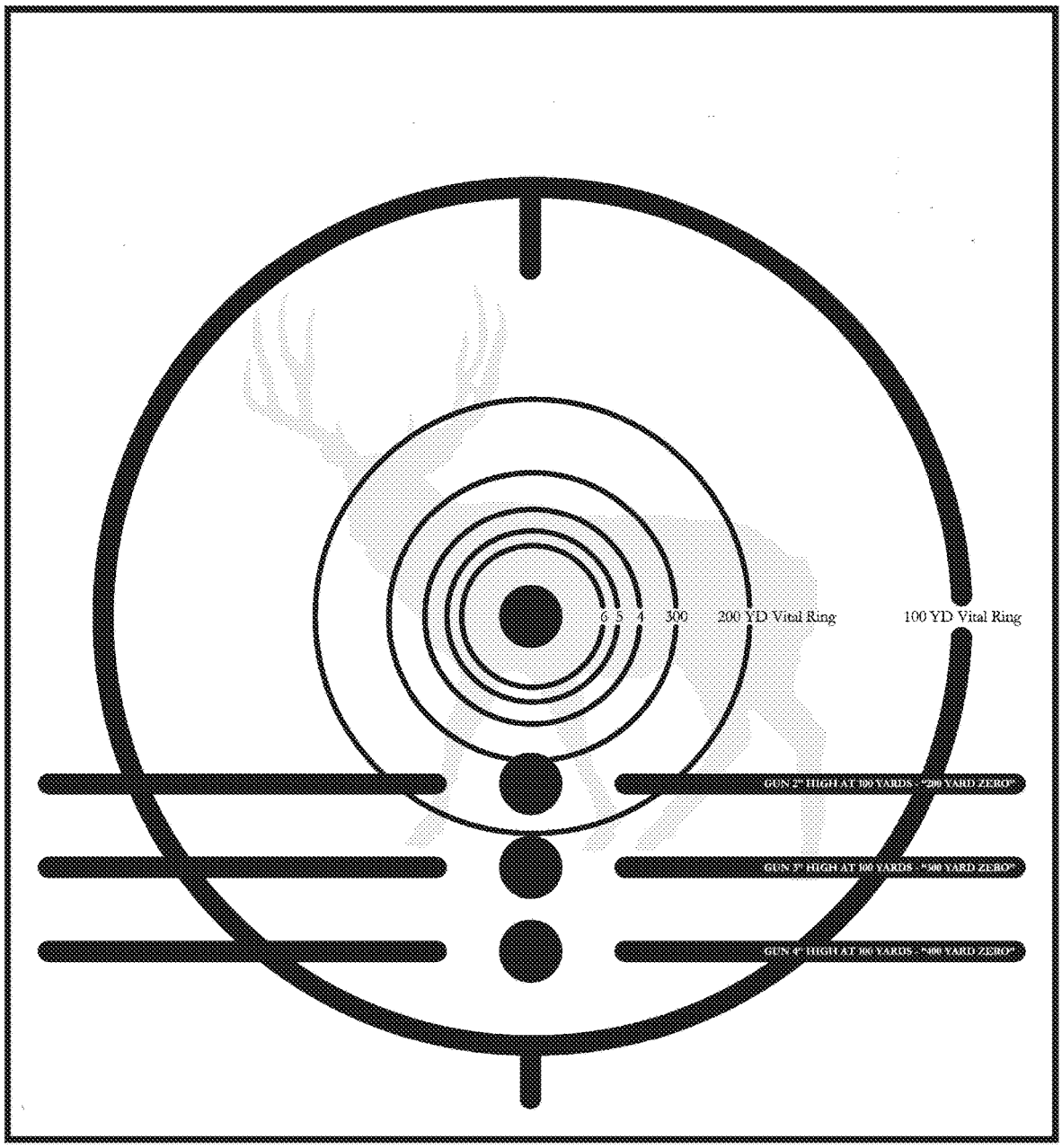

FIG. 14 represents a target of a mule deer according to one example of the principals described herein. In this example, the vital zone is sized for a mule deer and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 15:
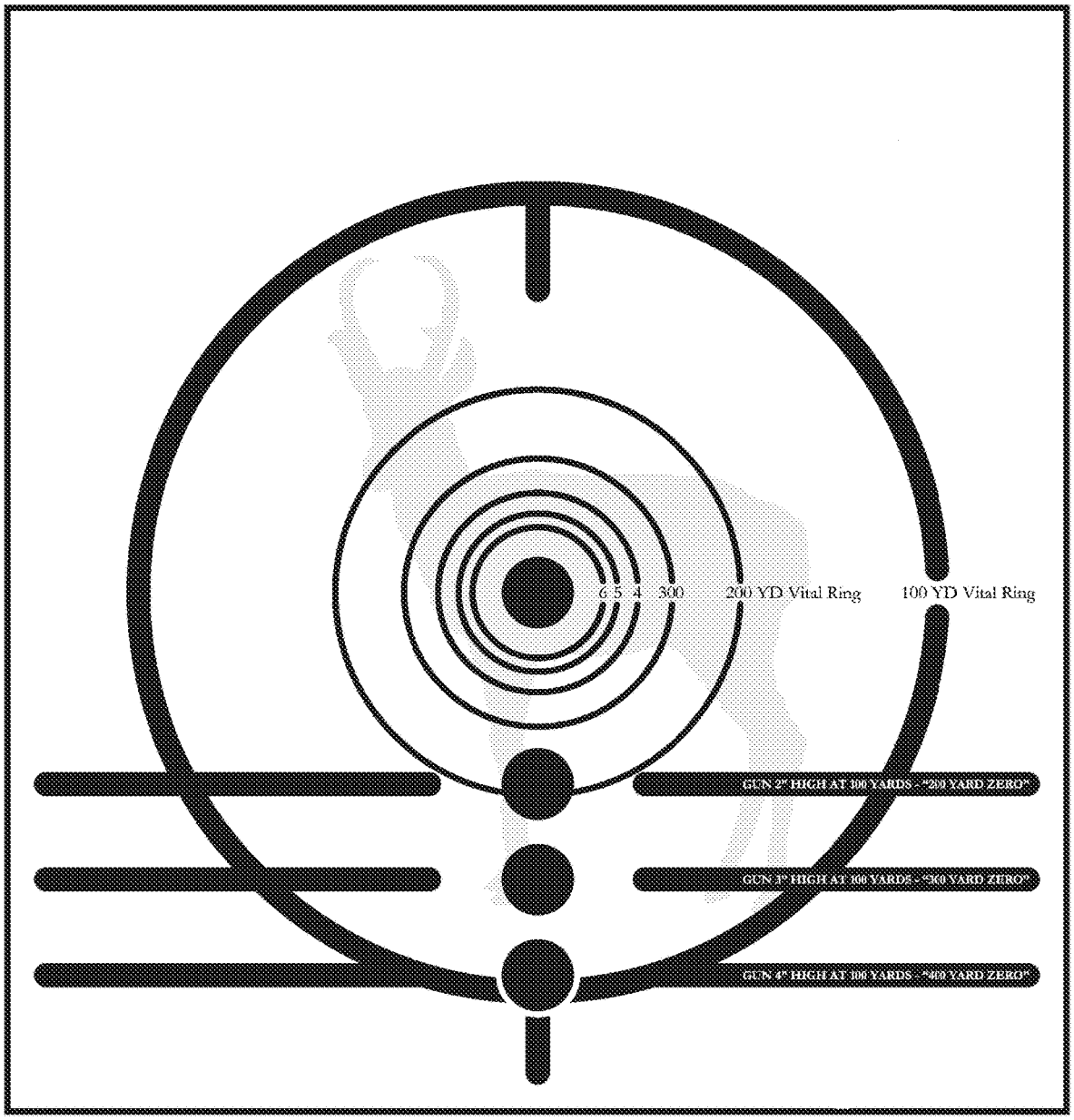

FIG. 15 represents a target of a pronghorn according to one example of the principals described herein. In this example, the vital zone is sized for a pronghorn and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 16:
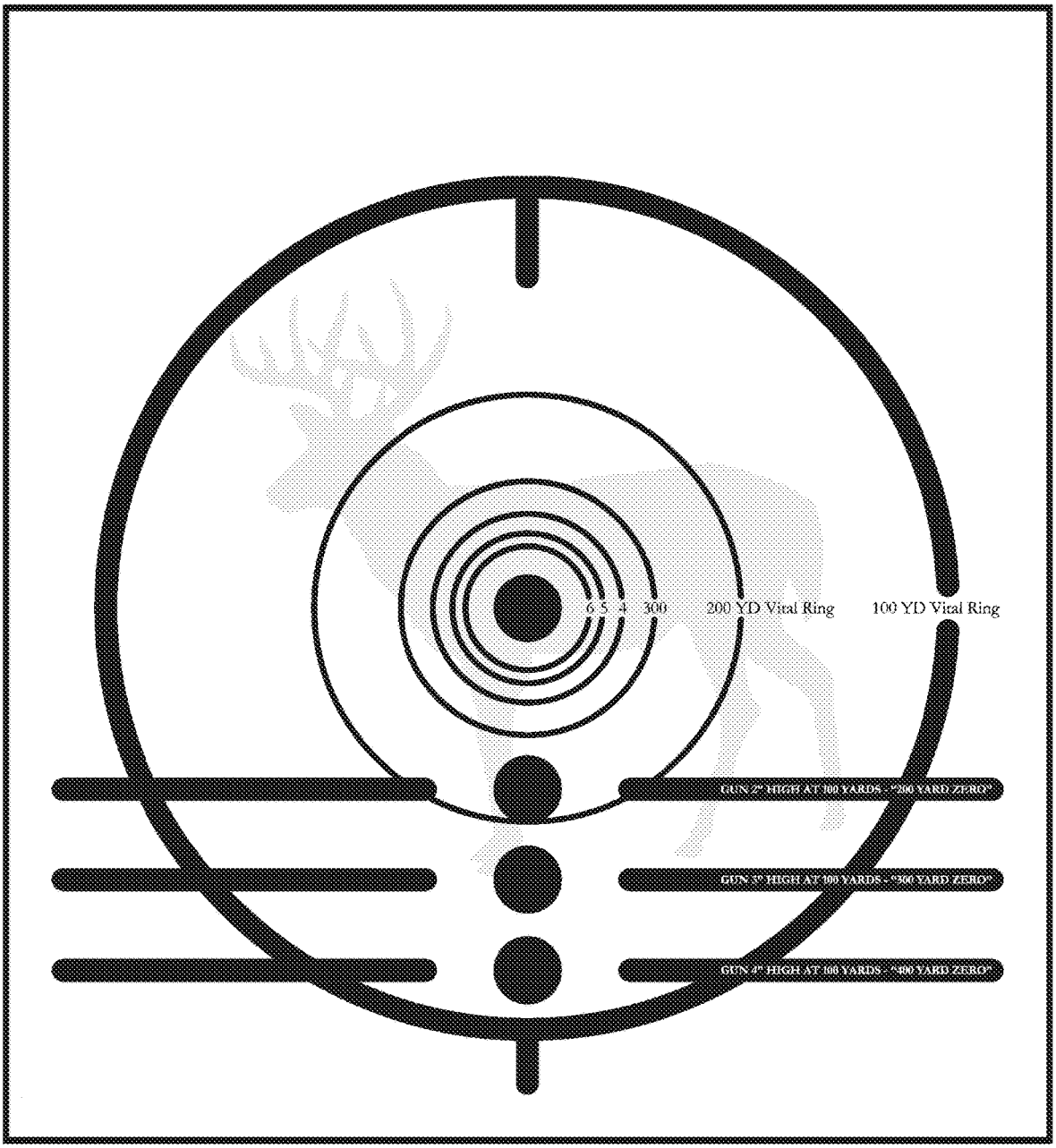

FIG. 16 represents a target of a whitetail deer according to one example of the principals described herein. In this example, the vital zone is sized for a white tail and set to be used at 100 yards. The vital zone is then adjusted to simulate 200, 300, 400, 500, and 600 yards. Additionally, secondary bullseyes are placed to account for the arch of the flight pattern of the projectile. The marksmen can adjust where the projectile strikes on the target by using an alternative bullseye.

Figure 17:
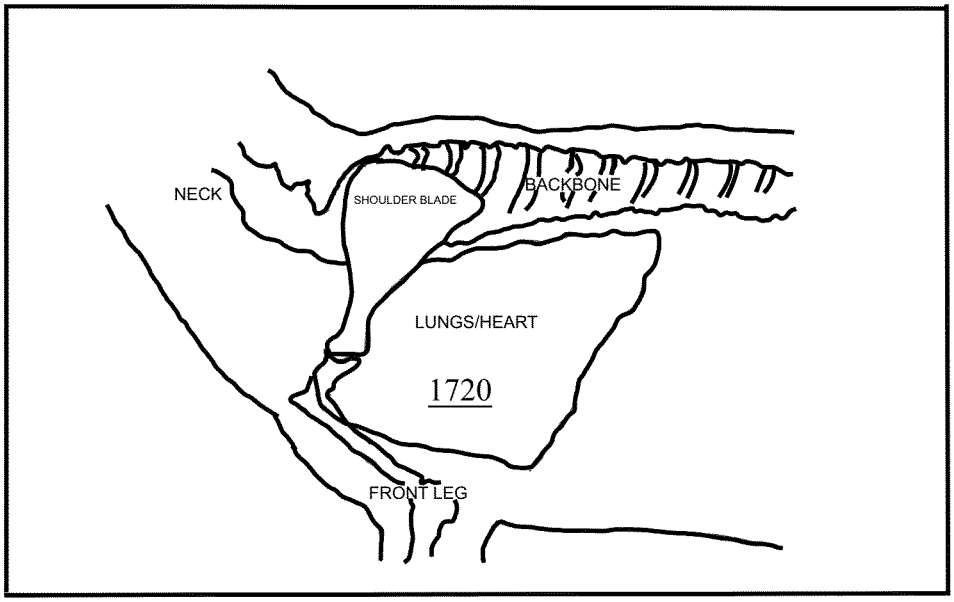
FIG. 17 represents a vital zone target according to one example of the principles described herein.

FIG. 17 represents a vitals target of an animal. The vital zone (1720) represent the vital zone of an animal. Vital zones indicate the location of vital organs, such as the heart, lungs, or brain.

Figure 18:
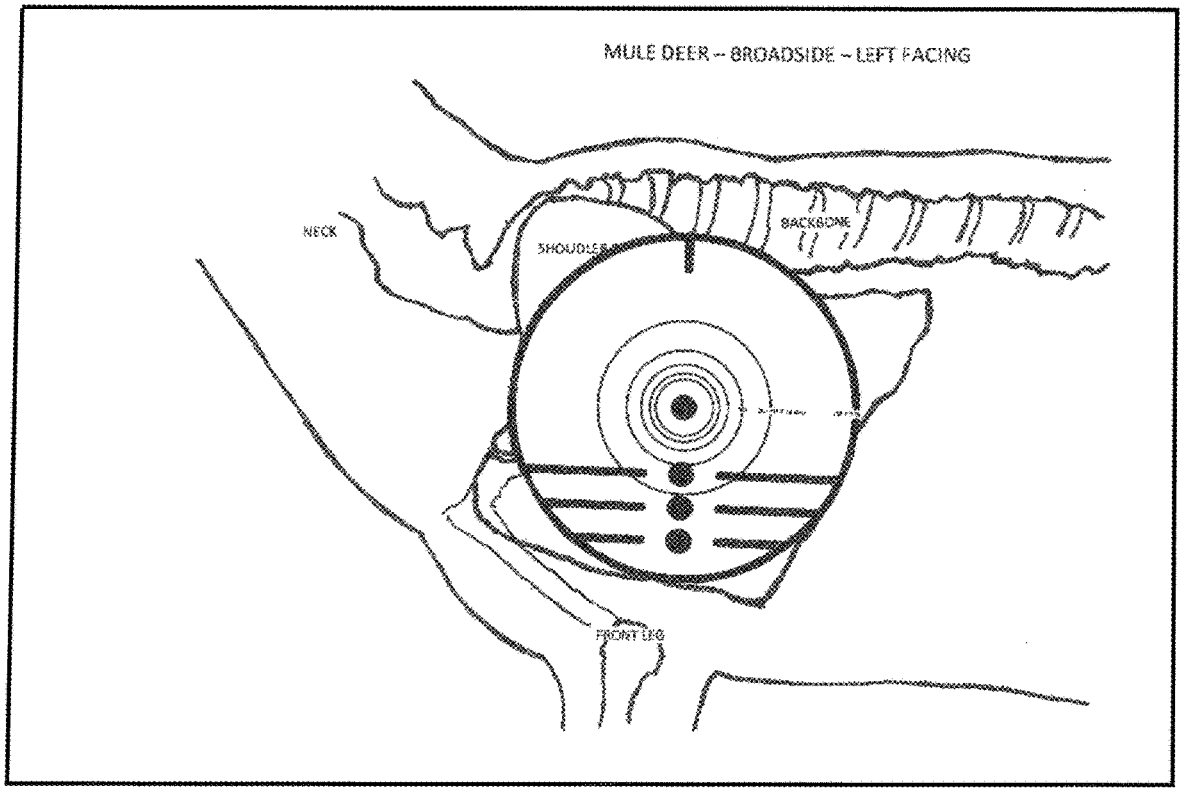
FIG. 18 represents a number of vital zone targets with identifying animals, according to one example of the principles described herein.

FIG. 18 represents a vitals target used to approximate the vital organs of animal. The vitals target (1821) indicates that shot placement that is most likely to indicate an ethical hunt. The vitals target (1821) may include representations of a plurality of vital zones for a plurality of distances.

In some embodiments the target may have horizontal lines with markers centered along the horizontal lines; the horizontal lines may be used as a reference point for someone aiming at the target.

The foregoing descriptions of embodiments have been presented only for purposes of illustration and description. They are not intended to be exhaustive or to limit the embodiments to the forms disclosed. Accordingly, many modifications and variations will be apparent to practitioners skilled in the art. Additionally, the above disclosure is not intended to limit the embodiments. The scope of the embodiments is defined by the appended claims.

The invention claimed is:

1. An apparatus for generating a vitals target, the apparatus comprising:

a processor;

an output device, the output device communicatively connected to the processor;

a non-transitory storage medium, the non-transitory storage medium comprising a number of modules, the number of modules comprising:

a target distance identify module, the target distance identify module identifying a target set distance for a target configuration;

a target animal identify module, the target animal identify module identifying an animal being simulated;

a vital zone determine module, the vital zone determine module determining a vital zone with a shape and size for the animal being stimulated;

a first distance identify module, the first distance identify module identifying a first distance being simulated at the target set distance, wherein the first distance corresponds to a first maximum shot distance for a shot strike for a humane hunt of the stimulated animal;

a target calculate module, the target calculate module rendering the vital zone for a target distance, and wherein the size of the vital zone is based on the first maximum shot distance; and an output generate module, the output generate module causing the output device to generate a vitals target.

2. The apparatus of claim 1, wherein the non-transitory storage medium further comprises a second distance identify module, the second distance identify module identifying a second distance being simulated, wherein the second distance is different than the first shot distance and corresponds to a second maximum shot distance for a shot strike for a humane hunt of the simulated animal.

3. The apparatus of claim 1, further comprising a direction determine module, the direction determine module simulating a rotation of a vital zone to simulate the animal being simulated standing at a determined angle.

4. The apparatus of claim 1, further comprising a trajectory calculate module, the trajectory calculate module calculating a trajectory of a projectile.

5. The apparatus of claim 4, where the trajectory calculate module analyzes the ballistic coefficient of the projectile.

6. A computer program product for generating a vitals target on a device, the computer program product comprising a memory resource, the memory resource comprising:

a target distance identifier, causing the device to identify a target set distance for a target configuration;

a target animal identifier, causing the device to identify an animal being simulated;

a vital zone determiner, causing the device to determine a vital zone with a shape and size for the animal being stimulated;

a first distance identifier, causing the device to identify a first distance being simulated at the target set distance, wherein the first distance corresponds to a first maximum shot distance for a shot distance for a shot strike for a humane hunt of the simulated animal;

a second distance identifier, causing the device to identify a second distance being simulated, wherein the second distance corresponds to a second maximum shot distance for a shot strike for a humane hunt of the simulated animal;

a direction determiner, causing the device to simulate a rotation of a vital zone to simulate an animal being simulated standing at a determined angle;

a target calculator, causing the device to render the vital zone for a target distance, and wherein the size of the vital zone based on the first or second maximum shot distance;

a trajectory calculator, causing the device to calculate a trajectory of a projectile; and an output generator, causing the device to generate a vitals target.

7. The computer program product of claim 6, wherein the output generator generates a plurality of vital zone targets.

8. The computer program product of claim 7, wherein the plurality of vital zone targets have a plurality of different center points based on the trajectory calculator.

9. The computer program product of claim 6, further comprising an animal overlayer to overlay an image of an animal corresponding to the vital zone on the vitals target.

10. The computer program product of claim 9, wherein the image of an animal is used to identify the vitals target.

11. A vitals target apparatus for training marksmanship, the apparatus comprising:

a plurality of vital zones, each vital zone indicating the vital zone of an animal to strike for a humane hunt at a specified distance; and a number of amulets, the amulets being the area between two vital zone outlines, the amulets representing the difference in grouping size used for a humane hunt at a plurality of different distances and measuring the skill of a marksmen; and a plurality of bullseyes, the bullseyes providing compensation for the trajectory of a projectile at an alternative distance.

12. The vitals target apparatus of claim 11, further comprising an image of an animal, the image of an animal indicating an animal that is selected as a hunting target.

13. The apparatus of claim 11, wherein the plurality of vital zones is shaped based on the angle the animal is targeted.

14. The apparatus of claim 11, wherein the plurality of vital zones are concentric.

15. The apparatus of claim 11, wherein the plurality of vital zones are sized to indicate a desired accuracy at a target distance to strike for a humane hunt at a first and second distance.

16. The apparatus of claim 11, wherein the plurality of vital zones are represented by circles.

17. The apparatus of claim 11, wherein the plurality of vital zones are shapes that are at least one of a circle, a triangle, a rectangle, an oval, an oblong, or an irregular shape.

* * * * *